United States Patent [19]

Odor

[11] Patent Number: 4,649,249

[45] Date of Patent: Mar. 10, 1987

[54] INDUCTION HEATING PLATEN FOR HOT METAL WORKING

[75] Inventor: Louis Odor, Columbus, Ohio

[73] Assignee: Rockwell International Corporation, El Segundo, Calif.

[21] Appl. No.: 776,064

[22] Filed: Sep. 13, 1985

[51] Int. Cl.[4] ..... H05B 6/10

[52] U.S. Cl. ..... 219/10.73; 219/10.67; 219/10.49 R; 100/93 R

[58] Field of Search ..... 29/10.73, 10.67, 10.69, 29/10.71, 10.75, 10.79, 10.49 R, 10.43, 10.57, 10.61 R, 243, 245, 246, 254, 255, 443, 457, 458, 460; 100/92, 93 R, 93 P; 165/168

[56] References Cited

U.S. PATENT DOCUMENTS

| | | | |
|---|---|---|---|
| 2,717,949 | 9/1955 | Challenner | 219/10.49 R |
| 3,041,434 | 6/1962 | Alf | 219/10.79 X |
| 3,754,499 | 8/1973 | Heisman et al. | 219/243 X |
| 3,790,735 | 2/1974 | Peters, Jr. | 219/10.49 R |
| 3,928,744 | 12/1975 | Hibino et al. | 219/10.49 R |
| 4,081,737 | 3/1978 | Miyahara | 219/10.57 X |
| 4,224,494 | 9/1980 | Reboux et al. | 219/10.73 X |
| 4,321,444 | 3/1982 | Davies | 219/10.71 X |

*Primary Examiner*—Philip H. Leung
*Attorney, Agent, or Firm*—Charles T. Silberberg; Chris Papageorge

[57] ABSTRACT

A platen for a press is disclosed providing fast heatup rate for materials to be superplastically formed, diffusion bonded, etc. The platen includes a ceramic plate having channels in its upper surface. A copper tube positioned within the channels conducts both electricity and cooling fluid therethrough. A metallic top plate positioned on top of the ceramic plate is induction heated by the electromagnetic field produced by the electrical current flowing through the copper tubing. A steel trough member covers the sides and bottom lengthwise portions of the copper tube in order to focus the electromagnetic waves upward into the top plate. The cover is composed of segments which are electrically insulated from each other in order to enhance the focusing effect. The ceramic plate is a heat and electrical insulator, and the upper surface thereof reflects radiant heat toward the top plate. A steel base plate provides firm support for the ceramic plate, the top plate and the other component elements.

3 Claims, 4 Drawing Figures

INDUCTION HEATING PLATEN FOR HOT METAL WORKING

BACKGROUND OF THE INVENTION

The invention relates to a platen heated by electromagnetic induction. The invention is adapted for use with a press in order to join and/or shape materials by the application of heat and pressure.

Heating platens are used in hot platen presses to heat tooling, sheet metal parts, parts to be diffusion bonded, parts to be superplastically formed and many other parts which require the application of pressure in order to join and/or shape the parts. It is desirable that such platens transfer heat uniformly to the workpiece and be capable of sustaining high compressive loads.

Generally, most prior art heating platen systems incorporate electrical resistance methods of heating. For example, U.S. Pat. No. 3,393,292 to Ritscher discloses a metallic platen using electrical resistance heating rods. The heating rods are positioned in recesses in a pressure plate and are unevenly spaced to compensate for heating losses at the edge of the plate. The primary shortcoming of this system, notwithstanding the positioning of the heating elements, is its inability to provide the required watt density to meet the requirements of efficient, cost effective, high temperature metal working.

U.S. Pat. No. 3,528,276 to Schmidt, et al, uses a cored metal platen to uniformly distribute and control the heat. Electrical resistance type heating elements are used. In addition, a liquid metal fills the bores in the platen in order to enhance heat transfer to the platen. Since this apparatus has a 1500° F. upper temperature limit, it cannot adequately support high temperature metal working operations. Thus, as exemplified by the Ritscher and Schmidt devices, the use of conventional resistance heaters as a primary heat source is inadequate for high temperature metal working operations.

Other prior art systems incorporate electrical resistance heating elements which are embedded in a ceramic platen. For example, U.S. Pat. No. 3,754,499 to Heisman, et al., discloses silicon carbide heating rods encased in ceramic which functions as a heat sink. Although the ceramic is used as a heat and electrical conductor, it is basically an insulator; thus, the ceramic is not able to transfer heat to the workpiece as well as metal heat sinks which are directly coupled to heating rods. Consequently, a primary disadvantage of this system is that it is not able to support rate production in the higher temperature ranges. Moreover, due to its inefficient method of heating and high maintenance requirements, it is limited to incorporation with relatively small platens. In addition, due to the slow and inefficient heating of the platen, the length of time at which the platen is required to be at or near the desired temperature tends to shorten the life of the heating platen system and increase the likelihood of atmospheric contamination.

Other prior art systems have used intermediary materials between the heating elements and the platen in order to provide more uniform heating of the platen. Such a system is exemplified by U.S. Pat. No. 3,478,192 to Fink. Fink discloses plates which are heated by electrical resistance elements. Oil circulates through the plates to equalize the temperature throughout the plates. The main disadvantage with this prior art system is that the heated oil concept embodied therein will not practically perform above 500° F. and therefore cannot support high temperature metal working operations.

A heating platen system is thus needed that will provide fast and efficient heating of tooling, sheet metal parts, parts to be diffusion bonded, parts to be superplastically formed and many press applications where materials are joined and shaped under heat and pressure.

SUMMARY OF THE INVENTION

It is a principal object of the present invention to provide a heating platen capable of attaining high temperatures very rapidly.

It is an object of the invention to provide a heating platen which can effectively transfer heat directly to the workpiece.

It is another object of the invention to provide a heating platen which is inexpensive to fabricate.

It is also another object of the invention to provide a heating platen which is efficient in heating the workpiece.

It is also another object of the invention to provide a heating platen which has a relatively long life and requires little or no maintenance.

It is still another object of the invention to provide a heating platen capable of withstanding high compressive loads.

The system of the present invention is specifically designed to provide a heating platen capable of attaining a temperature of approximately 1800° F. from room temperature in approximately 25 minutes. The system is capable of attaining a maximum temperature of over 2000° F. A metallic top plate transfers heat to the workpiece and contains heat energy therein. A ceramic plate sandwiched between the top plate and a base plate provides heat insulation and is also capable of high compressive forces such as may be required in diffusion bonding or superplastic forming operations. The top plate is heated by means of electromagnetic induction provided by an electrical current passing through conductors positioned in channels in the ceramic plate.

The heating system includes a top plate which is preferably a good electrical conductor and an electrically conducting tube positioned underneath and adjacent to the plate. The tube is proximal to, but not in contact with, the top plate. An electromagnetic field produced by elecrical current in the tube induces a current in the top plate. The resistance of the top plate to the current flow serves to heat the top plate. In order to effectively forcus the electromagnetic field up toward the top plate, an electrically conducting trough open at both lengthwise ends and at its top side is positioned around the tube covering its sides and bottom. The trough basically acts as a magnet in collecting the magnetic lines of force around the tube and focusing them at the upper ends of the trough.

A ceramic plate is positioned underneath the top plate and is channeled at an upper surface thereof in order to receive the electrically conducting tube therein. The ceramic is preferably composed of a material that can withstand high compressive forces in order to make the device more suitable for superplastic forming and diffusion bonding operations. The base plate is positioned underneath the ceramic plate and essentially provides support for both the ceramic plate and the top plate.

The ceramic plate is preferably both a heat insulator to prevent heat dissipation from the top plate and an electrical insulator to prevent dissipation of electrical current flow from the top plate. This enables the top plate to be able to hold more heat energy for a longer period of time than would otherwise be possible. Moreover, the upper surface of the ceramic plate reflects radiant heat from the top plate further preventing the escape of heat energy therefrom. Thus, the apparatus disclosed is very efficient in that it is able to rapidly heat the top plate to approximately 2000° F. as well as effectively contain the heat produced therein.

DETAILED DESCRIPTION OF THE PREFERRED EMBODIMENT

Figure 1:
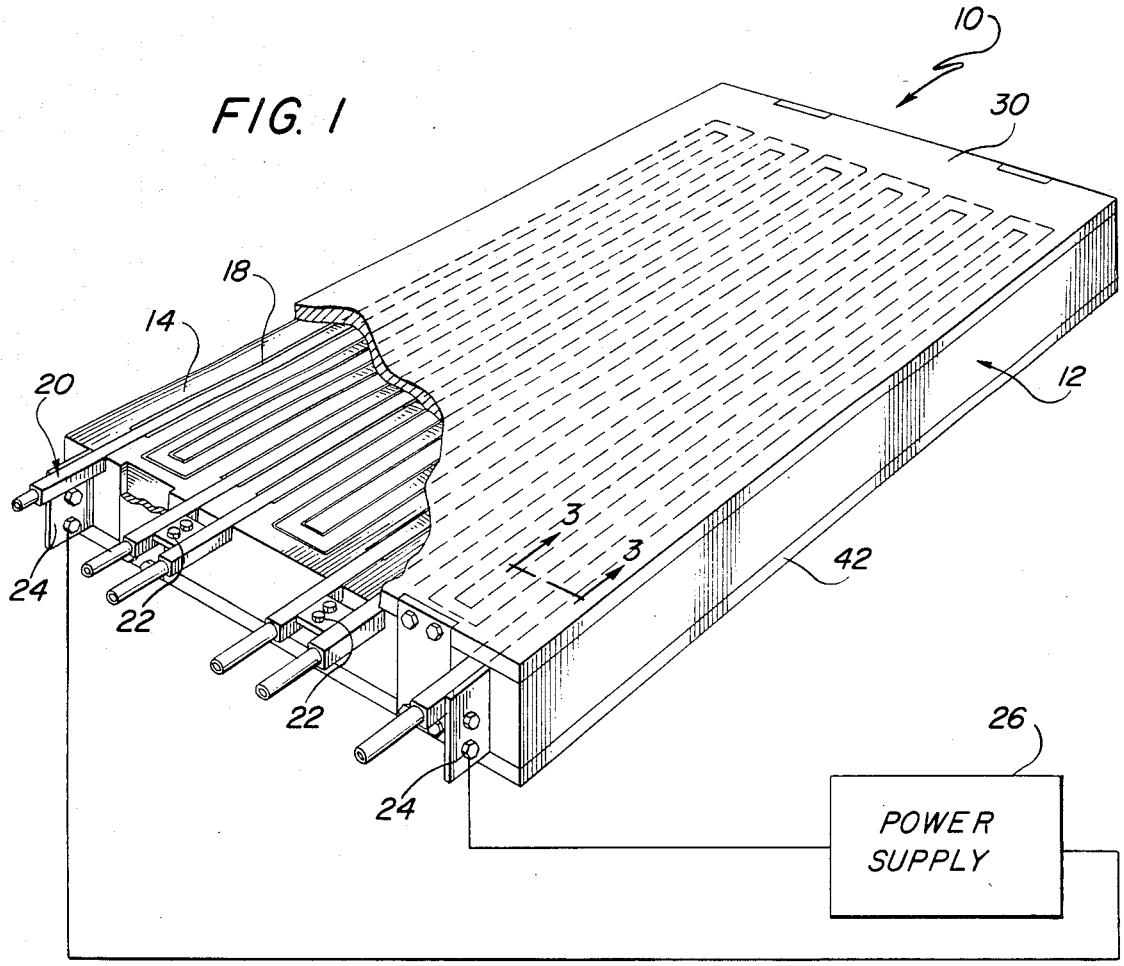
FIG. 1 is a perspective view of the heating platen.

Referring now to the drawings, the invention comprises a heating platen generally designated by the numeral 10. The heating platen 10 may be adapted to heat a variety of different types of workpieces (not shown).

Figure 2:
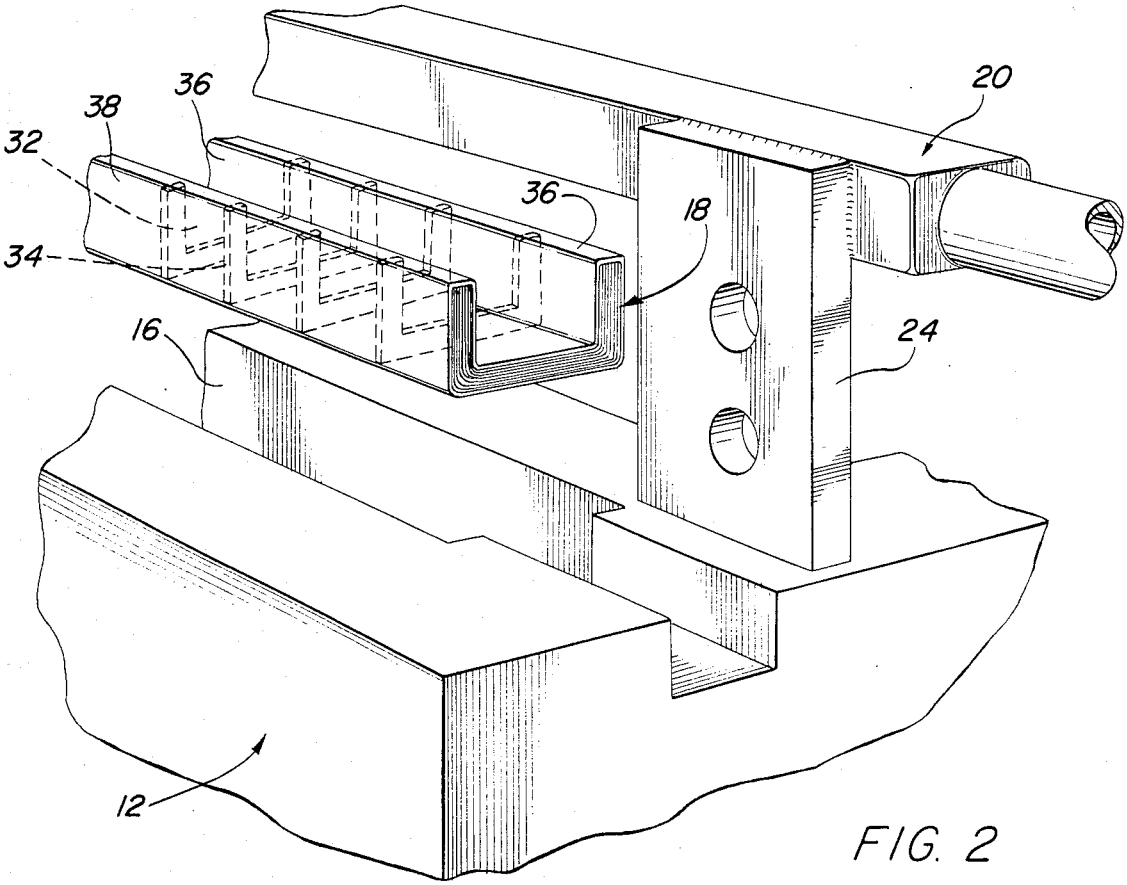
FIG. 2 is an exploded view of one corner of the heating platen more clearly showing the interrelationship between the component parts therein.
Figure 4:
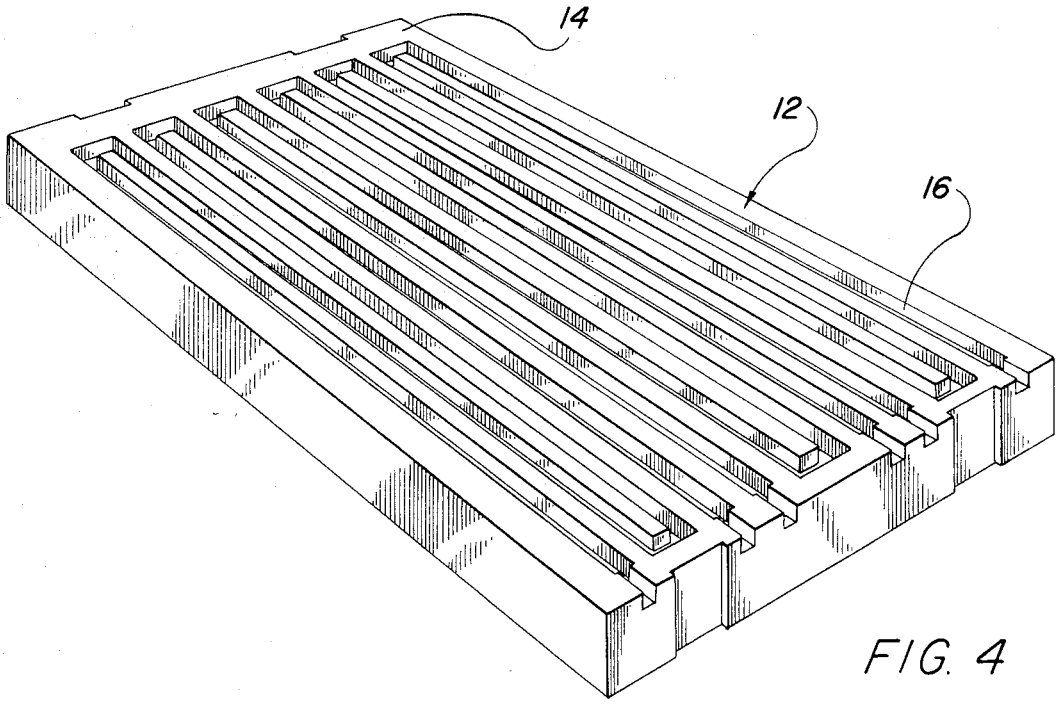
FIG. 4 is a perspective view of the ceramic plate showing the channels therein.

The platen 10 includes a plate 12 shown separated from the rest of the platen in FIG. 2. The plate 12 is composed of a ceramic material, preferably a highly refined heat treated silica ceramic such as Thermo-sil 120. This type of ceramic has the desired high compressive strength and heat and electrical insulation properties. The ceramic plate preferably is capable of withstanding compressive forces of approximately 5,000 psi at temperatures of approximately 1700° F. The high compressive strength enables the plate 12 to be subjected to the high pressures of superplastic forming and diffusion bonding operations. However, other suitable materials may also be used. The plate 12 has an upper surface 14 having channels 16 therein. The channels 16 preferably are evenly spaced and also preferably have a squared off generally sinusoidal shape in plan view as illustrated in FIG. 4. This particular shape and spacing of the channels 16 provide more uniform coverage of the upper surface 14 of the plate 12 for reasons which will be explained hereinbelow.

Ceramic plate 12 is preferably castable. The plate 12 may be cast with the use of a full scale, precision drawn mylar replica (not shown) of channels 16. Using the mylar replica as a pattern, an aluminum plate or plates (not shown) is machined into the desired shape and configuration of the particular channeled ceramic plate 12. The aluminum plate is positioned on a casting table and side boards are secured around it to produce a casting mold. The ceramic which is in the form of a liquid hydraulic setting mix is then poured into the mold and is simultaneously mechanically vibrated. After setting for twenty-four hours, the bottom of the still soft cast is sanded to match the sideboard producing a flat and parallel surface with the opposite face. Before the ceramic has fully set, the aluminum plate is removed from the ceramic plate 12 and from the sideboards. The cast is subsequently transferred to an oven where it is fired in stages to at least 1200° F. The heat curing imparts the desired heat reflecting and insulating properties to ceramic plate 12.

Figure 3:
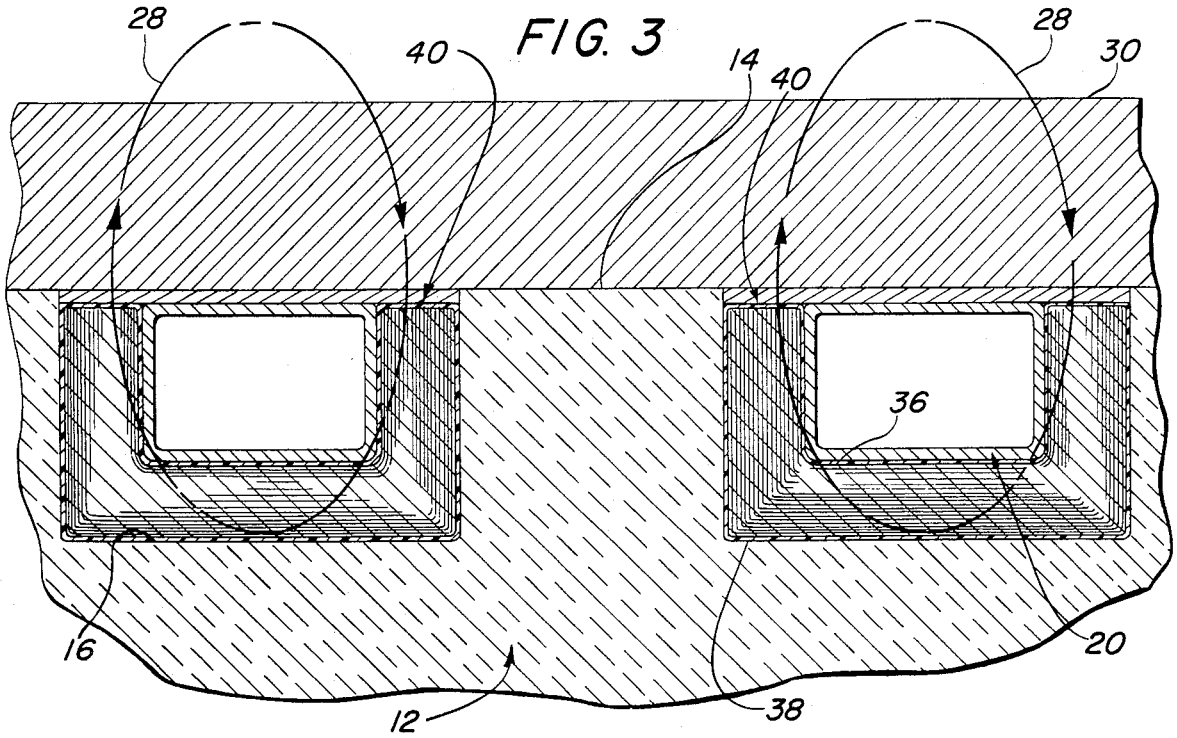
FIG. 3 is a cross sectional view of the platen of FIG. 1 taken along lines 3—3 and illustrating the magnetic lines of force produced by the electrical current flow.

Tubes 20, preferably composed of copper, are positioned in the channels 16. Tubes 20 conduct electricity and are interconnected at adjacent ends by a first set of electrical connectors 22. A second set of electrical connectors 24 connects the tubes 20 to a power supply 26. The electrical current flowing through tubes 20 sets up an electromagnetic field around the tubes 20. Electromagnetic lines of force 28 for one pair of tubes 20 are shown in FIG. 3 passing through the top plate 30. Because the top plate 30 is an electrical conductor, an electrical current is induced in the top plate 30 by the electromagnetic field. The resistance of the top plate 30 to flow of electrical current produces heat therein.

The material composition of the top plate 30 is preferably steel for maximum heat efficiency. Top plate 30 may be a steel alloy containing 30% nickel if high corrosion resistance is desired.

In order to focus the electromagnetic field induced by tubes 20 upwards into the top plate 30, a segmented trough 18, preferably ferrous, is positioned underneath and around the sides of the tube 20. The segments 32 of trough 18 are preferably 0.007 inch thick and 0.875 inch in length although their thickness may vary somewhat according to the size of the tubes 20. The segments 32 of the trough are electrically insulated from each other, preferably by coating each segment 32 with a plastic material 34 or by coating the lateral edge portions of the segments 32 with a plastic material 34 so that there is no elctrical communication between segments 32.

Magnetic lines of force generally take the path of least resistance. Therefore, since the segments 32 have a relatively high magnetic permeability, the magnetic lines of force 28 around tubes 20 tend to collect in segments 32. The lines of force 28 tend to spread out somewhat above the segments 32 in the areas of the top plate 30 but are nevertheless more concentrated than they would be without the segments 32. Consequently, the lines of force 28 above the trough 18 are distorted by the trough 18 into a more concentrated configuration. Thus, segmentation of the trough 18 serves to enhance the focusing of the electromagnetic field into the top plate 30.

The trough 18 is also electrically insulated from the tube 20, preferably by means of an electrical insulator 36 composed of a silicone rubber and ceramic cement compound positioned therebetween; otherwise, electrical current flow between the trough 18 and tubes 20 would tend to prevent the production of a magnetic field in the segments 32. There is also a filler 38, filling the gap between the trough 18 and the channels 16. Filler 38 may also be composed of a silicone rubber and ceramic cement compound or just a silicone rubber compound. The tubes 20 are also insulated from the top plate 30 in order to prevent the electrical current flowing through the tubes 20 from shorting out. The tubes 20 may be insulated from top plate 30 by extension of the silicone rubber and ceramic cement compound 36 over the top of the trough 18 or by a ceramic inlay 40 positioned over the trough 18 and the tubes 20, as shown in FIG. 3. The insulation 36 is preferably 1/16th of an inch thick, although the thickness may vary according to the size and power requirements of the particular heating platen.

Tubes 20 are also conduits for a cooling fluid, preferably water; since electrical resistance generally increases with temperature of the conductor, the cooling fluid prevents an increase in electrical resistivity of the tubes 20 due to the heat produced therein or produced in the top plate 30. This eliminates excessive power losses due to electrical energy being used to heat the electrically conducting tubes 20 rather than top plate 30. Consequently, the use of cooling fluid within tubes 20 enhances the heating efficiency of the platen thereby reducing its power consumption.

The frequency of the alternating current flowing through the tubes 20 is preferably optimized for heating efficiency to suit the type of metal used in the top plate 30. For example, the frequency of the AC current is approximately 10 khz for an aluminum top plate, 50 khz for a titanium top plate and 3 khz for a steel top plate.

Base plate 42 serves to support ceramic plate 12 as well as the top plate 30 and all the other component parts. Base plate 42 is preferably composed of a mild steel. Suitable hangars (not shown) may also be appropriately mounted on the platen 10 to provide a support means for moving or carrying the platen 10.

In operation, the workpiece to be heated is positioned on the top plate 30, and electrical current is fed to the electrically conducting tubes 20. The magnetic field produced by the current flowing in tubes 20 heats top plate 30 by electromagnetic induction. Heat energy induced in top plate 30 is transmitted to the workpiece by direct physical contact therewith.

Accordingly, there has been provided, in accordance with the invention, a heating platen that fully satisfies the objectives set forth above. It is to be understood that all terms used herein are descriptive rather than limiting. Although the invention has been described in conjunction with the specific embodiment set forth above, many alternatives, modifications and variations will be apparent to those skilled in the art in light of the disclosure set forth herein. Accordingly, it is intended to include all such alternatives, embodiments, modification and variations that fall with the spirit of the scope of the invention as set forth in the claims hereinbelow.

I claim:

1. A heating platen for use with a press, comprising: a castable ceramic plate having a channel at an upper surface thereof, the channel having an approximately sinusoidal shape in order to maximize area coverage of said upper surface of said ceramic plate, said ceramic plate being capable of withstanding compressive forces of approximately 5000 psi at temperatures of approximately 1700° F.;

a trough mounted within the channel, said trough being open at its upper lengthwise side, said trough being an electrical conductor, said trough comprising lengthwise segments, said segments having a plastic coating in order to provide electrical insulation from each other;

a top plate, said top plate being an electrical conductor;

an electrical power source;

a tube mounted within said trough, said tube electrically connected to said power source, said tube conducting cooling fluid therethrough in order to minimize increase in the electrical resistivity of said tube due to heating of the same, said tube conducting a low frequency electrical current to heat said top plate by means of electromagnetic induction such that a temperature of approximately 1800° F. can be attained within approximately 25 minutes;

a ceramic inlay mounted in the channel and covering said tube and said trough, said inlay electrically insulating said tube and said trough from said top plate;

a steel base plate supporting said ceramic plate;

an electrical insulator mounted between said trough and said tube, said electrical insulator composed of silicone rubber and ceramic cement material;

a filler mounted between said ceramic plate and said tube, said filler being composed at least partly of silicone rubber.

2. The platen of claim 1 wherein said ceramic plate is composed of a refined silica compound which is heat treated in stages to at least 1200° F.

3. A heating platen for use with a press, comprising:

a castable ceramic plate having a channel at an upper surface thereof, said ceramic plate being capable of withstanding compressive forces of approximately 5000 psi at temperatures of approximately 1700° F.;

a trough mounted within the channel, said trough being open at its upper lengthwise side, said trough being an electrical conductor, said trough comprising lengthwise segments, said segments being electrically insulated from each other;

a top plate, said top plate being an electrical conductor;

an electrical power source;

a tube mounted within said trough, said tube electrically connected to said power source, said tube conducting cooling fluid therethrough in order to minimize increase in electrical resistivity of said tube due to heating of the same, said tube conducting an electrical current to heat said top plate by means of electromagnetic induction;

an electrical insulating inlay mounted in the channel and covering said tube and said trough, said inlay electrically insulating said tube and said trough from said top plate;

a base plate supporting said ceramic plate;

an electrical insulator mounted between said trough and said tube; and a filler mounted between said ceramic plate and said tube.

* * * * *